US010332483B1

(12) United States Patent
Ge et al.

(10) Patent No.: US 10,332,483 B1
(45) Date of Patent: Jun. 25, 2019

(54) SYSTEMS AND METHODS FOR PROVIDING INTELLIGENT DISPLAY BRIGHTNESS CONTROL

(71) Applicant: Marvell International Ltd., Hamilton (BM)

(72) Inventors: Zhirong Ge, Shanghai (CN); Dam Le Quang, Q. Tan Binh (VN)

(73) Assignee: Marvell International Ltd., Hamilton (BM)

( * ) Notice: Subject to any disclaimer, the term of this patent is extended or adjusted under 35 U.S.C. 154(b) by 301 days.

(21) Appl. No.: 15/233,578

(22) Filed: Aug. 10, 2016

Related U.S. Application Data

(60) Provisional application No. 62/234,142, filed on Sep. 29, 2015.

(51) Int. Cl.
*G09G 5/02* (2006.01)
*G09G 5/10* (2006.01)

(52) U.S. Cl.
CPC ..... *G09G 5/10* (2013.01); *G09G 5/02* (2013.01); *G09G 2320/0295* (2013.01); *G09G 2320/0626* (2013.01); *G09G 2320/0666* (2013.01); *G09G 2320/0693* (2013.01)

(58) Field of Classification Search
CPC . G03F 7/70283; G03F 7/70291; H04N 5/355; G06Q 10/109
USPC ..... 345/589
See application file for complete search history.

(56) References Cited

U.S. PATENT DOCUMENTS 6,999,197 B1 * 2/2006 Nabeshima ..... H04N 1/4072 358/1.9
2007/0206014 A1 * 9/2007 Furui ..... G09G 5/00 345/442
2009/0220151 A1 * 9/2009 Lin ..... H04N 1/62 382/167
2011/0273495 A1 * 11/2011 Ward ..... G09G 3/3413 345/694
2012/0218314 A1 * 8/2012 Purdy ..... G09G 3/3208 345/690

FOREIGN PATENT DOCUMENTS

JP 2016134900 A * 7/2016

* cited by examiner

*Primary Examiner* — Vu Nguyen

(57) ABSTRACT

Some embodiments described herein provide a method for providing brightness control of a display. An image including a first pixel associated with a first color and a second pixel associated with a second color may be obtained for display. A first brightness control mapping may be designed for the first color and a second brightness control mapping may be designed for the second color. Linear interpolation between the first brightness control mapping and the second brightness control mapping may be applied for a third pixel within the image having a third color different from the first color and the second color. The first, second and third brightness control mapping may then be applied to the first, second and third pixels, respectively. An output image including the first pixel, the second pixel and the third pixel may be displayed after the applying.

16 Claims, 4 Drawing Sheets

SYSTEMS AND METHODS FOR PROVIDING INTELLIGENT DISPLAY BRIGHTNESS CONTROL

CROSS-REFERENCE TO RELATED APPLICATION

This disclosure claims the benefit of U.S. Provisional Patent Application No. 62/234,142, filed Sep. 29, 2015, which is hereby incorporated by reference herein in its entirety.

FIELD OF USE

This disclosure relates to an intelligent brightness control mechanism for displays.

BACKGROUND OF THE DISCLOSURE

The background description provided herein is for the purpose of generally presenting the context of the disclosure. Work of the inventors hereof, to the extent the work is described in this background section, as well as aspects of the description that may not otherwise qualify as prior art at the time of filing, are neither expressly nor impliedly admitted to be prior art against the present disclosure.

In the display system of an electronic device, display content from a video source, even a digital source, is usually imperfect. To improve display quality, display parameters, including brightness, saturation, and hue can be adjusted. A family of color spaces used as a part of the color image pipeline in video and digital photography systems, known as the YCbCr color space, is used for brightness, saturation, and hue controls. Y denotes the luma component and Cb and Cr are the blue-difference and red-difference chroma components, respectively.

For example, hue and saturation controls of CbCr processing can be used in most television settings. The hue parameter of a pixel may often determine the color of the pixel, and the chroma parameter may determine the saturation or vividness of the color. A value of 128 is subtracted from the value of Cb and Cr to position the range about zero. The hue control can be implemented by mixing the Cb and Cr data:

$$Cb' = Cb \cos\theta + Cr \sin\theta$$

$$Cr' = Cr \cos\theta - Cb \sin\theta$$

where θ is the desired hue angle. An example 8-bit hue adjustment range is −30° to +30°. The saturation control can be implemented by multiplying both Cb and Cr by a constant. An example 8-bit saturation adjustment range is 0-1.992. Finally, the value of 128 can be added back to both Cb and Cr.

Some displays also use separate hue and saturation controls for each of the red, green, blue, cyan, yellow, and magenta colors. This can facilitate tuning the image at production time to better match the display's characteristics. The adjustment of the display parameters such as the hue, saturation or brightness, can be complicated, and a user usually tries different combination of parameters to seek a satisfactory setting based on empirical data. Thus, the parameter tuning process can be tedious and inefficient.

SUMMARY

Some embodiments described herein provide a method for providing brightness control of a display. An image including a first pixel associated with a first color and a second pixel associated with a second color may be obtained for display. A first brightness control mapping may be designed for the first color, and a second brightness control mapping may be designed for the second color. Linear interpolation between the first brightness control mapping and the second brightness control mapping may be applied for a third pixel within the image having a third color different from the first color and the second color. The first brightness control mapping may then be applied to the first pixel based on a first saturation value of the first pixel. The second brightness control mapping may then be applied to the second pixel based on a second saturation value of the second pixel. The linear interpolation may then be applied to the third pixel based on a third saturation value of the third pixel. An output image including the first pixel, the second pixel and the third pixel may then be displayed after the applying.

In some implementations, the first color and the second color belong to a color axis.

In some implementations, for the first brightness control mapping, a piecewise linear gradient may be designed such that a second derivative of the first brightness control mapping is a constant.

In some implementations, the first brightness control mapping may be derived based on the designed piecewise linear gradient.

In some implementations, a set of colors may be selected including the first color and the second color. Each color from the set of colors is associated with a respective color axis, and each respective color axis is associated with a designed brightness control mapping.

In some implementations, the first color has a first hue value, the second color has a second hue value and the third color has a third hue value, and wherein the first hue value is lower than the third hue value.

In some implementations, the second hue value is higher than the third hue value.

In some implementations, the first saturation value of the first pixel may be determined, and compared with a first previously defined saturation threshold and a second previously defined saturation threshold. The first previously defined saturation threshold is lower than the second previously defined saturation threshold.

In some implementations, the first pixel of the output image may be displayed without brightness adjustment from the image when the first saturation value is lower than the first previously defined saturation threshold.

In some implementations, the first brightness control mapping may be applied to the first pixel when the first saturation value is higher than the second previously defined saturation threshold. A brightness parameter may then be re-calculated for the first pixel of the output image when the first saturation value is between the first previously defined saturation threshold and second previously defined saturation threshold.

According to another embodiment described herein, a system for brightness control of a display is provided. The system includes an input interface configured to obtain an image including a first pixel associated with a first color and a second pixel associated with a second color for display. The system further includes control circuitry communicatively coupled to the input interface. The control circuitry is configured to design a first brightness control mapping for the first color and a second brightness control mapping for the second color. The control circuitry is further configured to apply linear interpolation between the first brightness control mapping and the second brightness control mapping for a third pixel within the image having a third color different from the first color and the second color. The control circuitry is further configured to apply the first brightness control mapping to the first pixel based on a first saturation value of the first pixel, apply the second brightness control mapping to the second pixel based on a second saturation value of the second pixel, and apply the linear interpolation to the third pixel based on a third saturation value of the third pixel. The system further includes an output interface to display an output image including the first pixel, the second pixel and the third pixel after the applying.

BRIEF DESCRIPTION OF THE DRAWINGS

Further features of the disclosure, its nature and various advantages will become apparent upon consideration of the following detailed description, taken in conjunction with the accompanying drawings, in which like reference characters refer to like parts throughout, and in which.

DETAILED DESCRIPTION

This disclosure describes methods and systems for an intelligent brightness control mechanism for displays. According to this disclosure, a brightness control mechanism is adopted to brighten or darken each color in a configurable range within a display image respectively, without introducing any side effect such as changing the brightness value of pixels of colors outside the range. A mapping function can be designed for brightness control with linear interpolation between two adjacent color axes (e.g., two adjacent colors on the color spectrum), and disable brightness control when saturation is very low. The mapping function may be designed such that no side effect such as a sharp change in the brightness parameter value. Thus, the mapping function may avoid side effects such as a white stripe on the image. When an image is received at a display device, the brightness control mechanism may automatically adjust the brightness parameter of each pixel within the image based on the mapping function without a user having to manually adjust the brightness parameter to avoid any white-stripe display side effect.

In some implementations, the saturation and hue parameters can be adjusted for a selected collection of separate and independent colors. Although brightness control of Y processing may not be often used in consumer displays, adjusting the brightness for certain colors can be used to enhance display quality in addition to hue and saturation controls. Specifically, a new process is described herein that allows adjustment (e.g., by users) of the brightness parameter together with the hue and saturation parameters for a selected collection of independent colors.

In some implementations, the intelligent brightness control approach described herein may make each of a collection of 14 colors (e.g., a range of 14 colors developed based on the three primary colors red, yellow and blue) brighter or darker in a configurable range without incurring any side effects.

Figure 1:
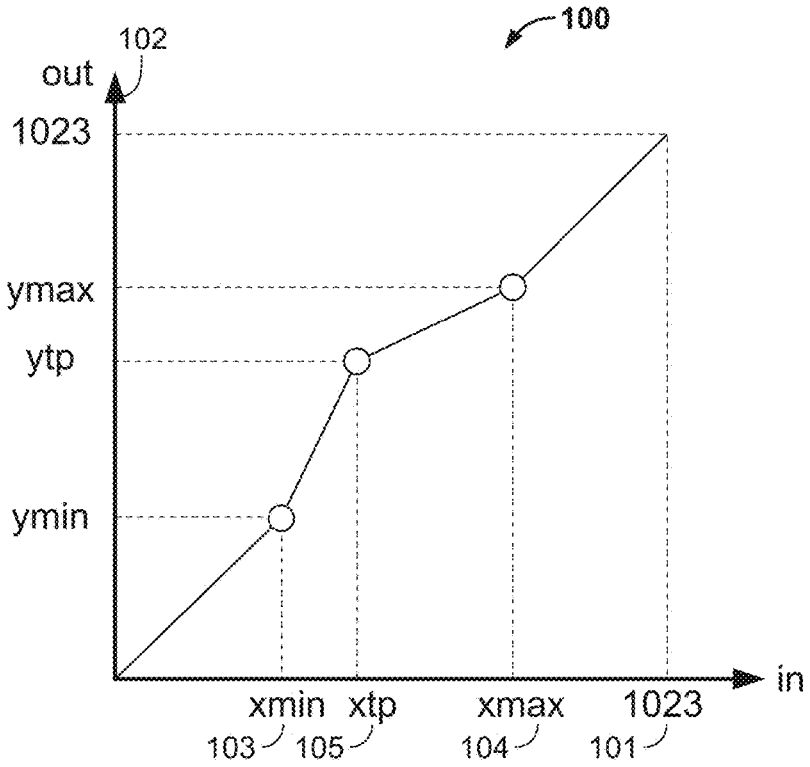
FIG. 1 provides an exemplary diagram illustrating a piece-wise linear brightness control function, in accordance with various embodiments of the disclosure.

A rapid change in brightness may cause side effects in displaying the collection of 14 colors. The illustrative chart 100 in FIG. 1 shows an example implementation of brightness control by using a piecewise linear function to adjust the brightness parameter for specific colors (e.g., associated with a specific wavelength) with brightness values in the range of $[x_{min}, x_{max}]$. The x-axis 101 of chart 100 represents the original brightness values for an input color, and the y-axis 102 of chart 100 represents the output brightness parameter value for the respective input color. In this case, the gradient of the piecewise linear function may change significantly at $x_{min}$ 103, the turning point 105, and $x_{max}$ 104. Human vision can be very sensitive to such rapid change, and thus display side effects may occur in such case.

Figure 2:
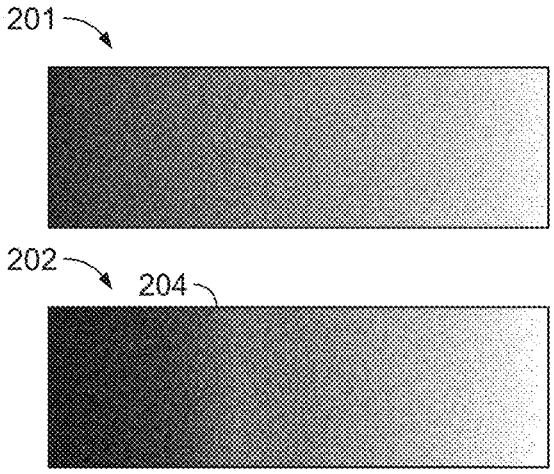
FIG. 2 provides an exemplary diagram illustrating side effects of brightness control using the piece-wise linear brightness control function in FIG. 1, in accordance with various embodiments of the disclosure.

FIG. 2 provides two example gray images to illustrate the side effects caused by the piecewise linear brightness control in FIG. 1. Image 201 represents the original image with original brightness parameters, and image 202 represents the image with brightness parameters adjusted by the brightness control mapping function in FIG. 1. For example, if two piecewise lines are defined in the range of brightness values of [256, 512], the turning point is located at 384 with a gain of 96, and side effects can be seen at 204. This side effect can be significant when the brightness value is 384. A brighter line 204 can be observed present at this position, which renders the display image 202 different from the original image 201.

In order to avoid the side effect, the first derivative of a brightness control function can be designed to change smoothly. In other words, the second derivative of brightness control function may be configured to be a constant. The design of a brightness control function can be part of the intelligent brightness control, as discussed in connection with FIG. 3.

Figure 3:
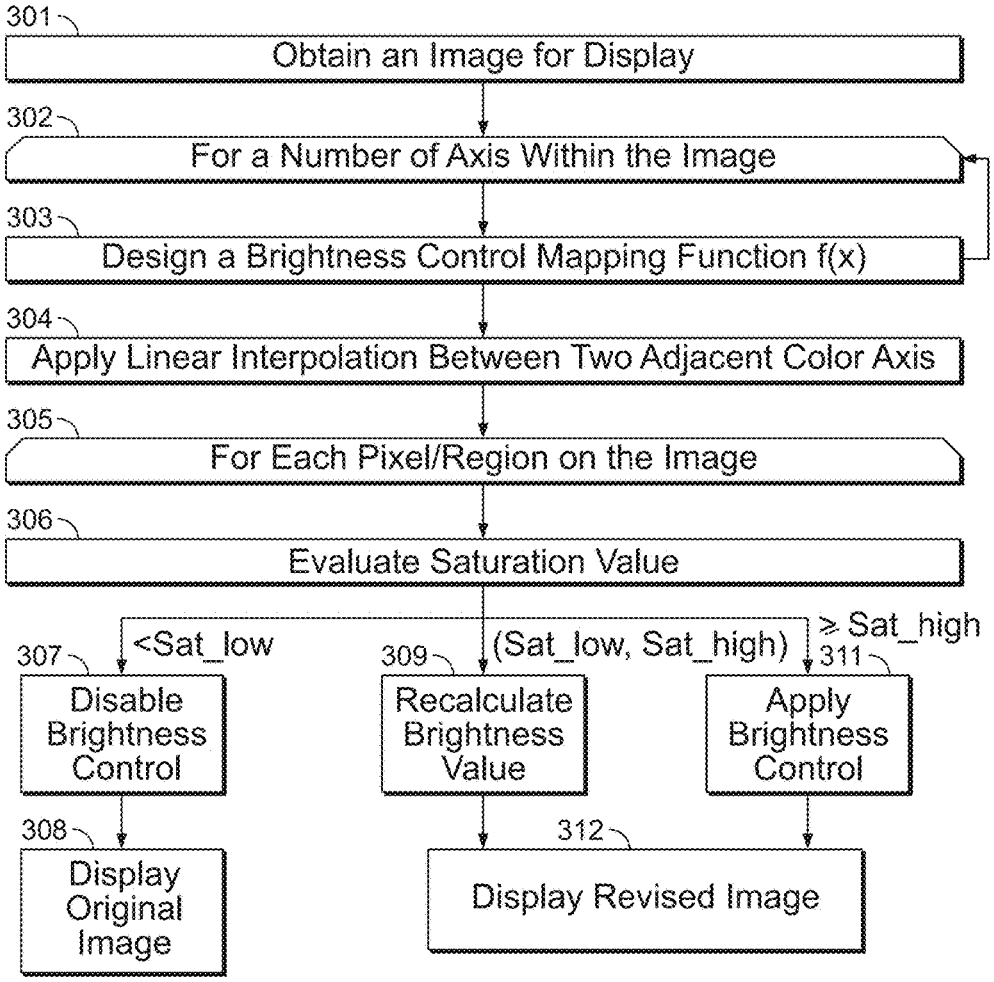
FIG. 3 provides an exemplary logic flow diagram illustrating work flow for intelligent brightness control, in accordance with various embodiments of the disclosure.

FIG. 3 provides an example logic flow illustrating aspects of a process for brightness control. An image is received at 301, e.g., a still image, a frame grab from a video, etc. The image may be received at 301 via a brightness control component that processes the image for subsequent display. At 302, for a number of color axes (e.g., 14 colors derived from the three primary colors) within the image, a brightness control mapping function f(x) can be designed at 303. The number of color axes may be determined at 302 or may be received at 302. The process may loop through each color axis of the image to determine a corresponding brightness control mapping function f(x) at 303.

Figure 4:
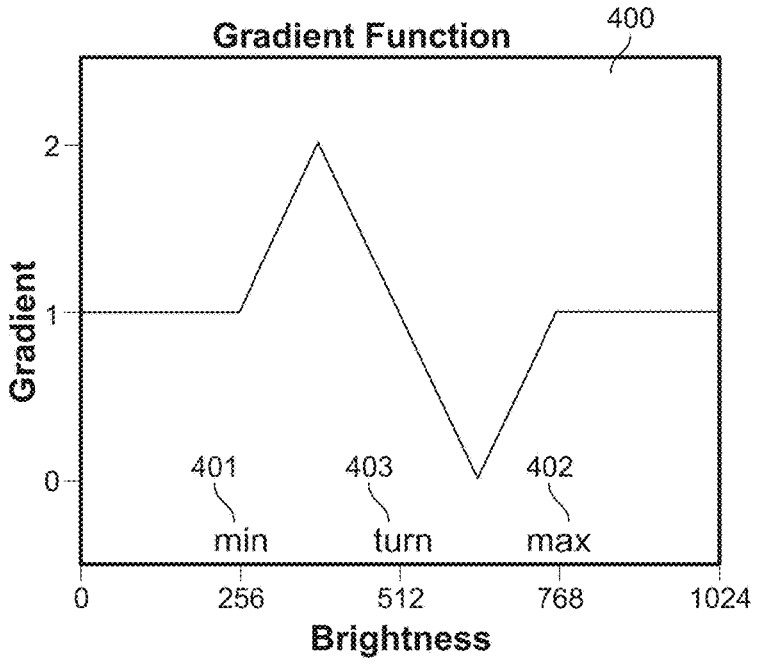
FIG. 4 provides an exemplary diagram illustrating an example gradient function for brightness control design, in accordance with various embodiments of the disclosure.

An example gradient design of a brightness control function determined at 303 is shown in FIG. 4. For example, when a user wants to increase the brightness value in the range of $[x_{min}, x_{max}]$ the maximum gain takes place at the turning point 403. The brightness control function then may be designed to be monotone increasing in order to ensure one-to-one mapping between the input and the output. The gradient at $x_{min}$ 401 and $x_{max}$ 402 can be set to be 1. For example, when the input value increases from 0 to $x_{min}$, the corresponding gradient may be set to be 1; and when the input value increases from $x_{min}$, the gradient may be set to increase from 1 to a value greater than 1. When the input value gets close to $x_{max}$, the gradient can be set to decrease from the value greater than 1 to 1. In order for the gradient to change more smoothly, the turning point can be set at the middle of $x_{min}$ and $x_{max}$, and the gradient at the turning point can be set as 1.

Given the gradient function df/dx, the primary function f(x) can thus be derived. Assuming the mapping curve between $x_{min}$ and $x_{max}$ is divided into a number num of piecewise linear lines, here num is equal to ($x_{min}-x_{max}$). As a result, the input length for each piecewise linear segment is 1.

The gradient for each piecewise linear segment in the range [$x_{min}$, $x_{max}$] can be distributed as the following: {1+k, 1+2k, 1+3k, . . . , 1+nk, 1+(n+1)k, 1+nk, . . . 1+3k, 1+2k, 1+k} The gradient for each piecewise linear segment in the range [turning point, $x_{max}$] can be distributed as the following: {1−k, 1−2k, 1−3k, . . . , 1−nk, 1−(n+1)k, 1−nk, . . . 1−3k, 1−2k, 1−k} The difference between the input and the output at the turning point is calculated as the brightness gain, which is equivalent to k+2k+3k+ . . . +nk+(n+1)k+nk+ . . . , +3k+2k+k=(((1+n)×n/2)+(n+1)+((1+n)×n/2))×k. On the other hand, if a desired brightness gain is set, the value of k can be set as equal to gain/(n+1)2.

Other variables used in the derivation of f(x) can be obtained:

$$t_0=(x_{min}+\text{turning point})/2;$$

$$t_1=(\text{turning point}+x_{max})/2;$$

Assuming there are (2n+1) points between $x_{min}$ and the turning point, and (2n+1) points between the turning point and $x_{max}$, then the number of piecewise linear segments num is equal to (4n+3).

For points outside the range ($x_{min}$, $t_0$], f(x)=×k+2k+ . . . (x−min)k. If m=x−$x_{min}$, then f(x)=x+(1+m)×m/2×k.

For points within the range ($t_0$, turn), f(x)=x+gain−((turn−1−x)k+ . . . +2k, k). If m=turn−1−x, then f(x)=x+gain−(1+m)×m/2×k. For the turning point, f(x)=x+gain.

For points within the range (turn, $t_1$], f(x)=x+gain+(−k)+(−2k)+ . . . +(−(x−turn)k). If m=x−turn, then f(x)=x+gain−(1+m)×m/2×k.

For points within the range ($t_1$, $x_{max}$), f(x)=x+(max−x)k+ . . . +2k+1k. If m=max−1−x, then f(x)=x+(1+m)×m/2×k. For the calculation such as (1+m)×m/2×k, as k=gain/(n+1)2, then it can be simplified as gain×(1+m)×m/2/(n+1)2. For hardware design, the value n+1 can be adjusted to the closet value that is a power of 2. In this case, division can be replaced by a right shift operation. When 10 bits are used for brightness control, the parameter num=4n+3 can reach the maximum value of 1023. In such case ($x_{min}$=0 and $x_{max}$=1023), and the calculation of ((1+m)×m/2×k) can be simplified as (gain×(1+m)×m)>>17, wherein ">>17" denotes an operation of right-shifting by 17 bits. Or mathematically, the operation ">>17" is equivalent to dividing a value by $2^{17}$.

If d(x) is defined as f(x)−x, by using a right shift operation, d(x) can be derived similarly as the following:

TABLE 1

Calculation of d(x)

| d(x) | m | x range |
|---|---|---|
| (gain × (1 + m) × m) >> 17 | x − min | (min, t0] |
| gain − ((gain × (1 + m) × m) >> 17) | turn − 1 − x | (t0, turn) |
| Gain | 0 | turn |
| gain − ((gain × (1 + m) × m) >> 17) | x − turn | (turn, t1] |
| (gain × (1 + m) × m) >> 17 | max − 1 − x | (t1, max) |

For gain>0, f(x)=x+d(x).

For gain<0, the absolute value of the gain is used to calculate d(x), then f(x)=x−d(x).

In order to keep f(x) monotone increasing, the condition (1−mk)≥0 shall be satisfied. The maximum value of m can be n+1, then 1−(n+1)×gain/(n+1)2≥0, i.e. gain≤(n+1). So the range of the gain is [−(n+1), n+1]. In the typical case with $x_{min}$=0, $x_{max}$=1024, the gain can be set in the range [−256, 256].

Figure 5:
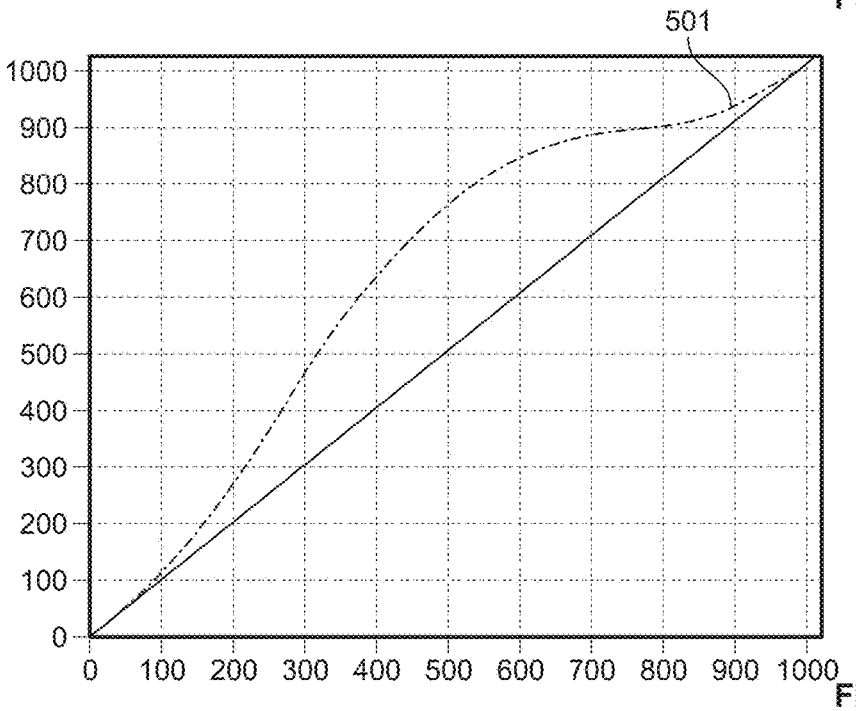
FIG. 5 provides an exemplary diagram illustrating an example brightness control curve, in accordance with various embodiments of the disclosure.

FIG. 5 shows an example mapping curve when gain=256. The tangent of the curve 501 may change smoothly within the input range [0, 1000]. In order to reduce the number of registers for brightness control, the brightness control parameters can be set as $x_{min}$=0, $x_{max}$=1024, turn=512. Thus only a set of 14 registers for gain may be obtained and used.

Back to FIG. 3, at 303, linear interpolation between two adjacent color axes can be applied. Pixels that lie on the same axis can be subject to the same brightness control function f(x) determined by the gain associated with the respective axis. Meanwhile, for other pixels to fall into the region between two adjacent axes, linear interpolation of brightness change can be applied.

For example, $f_1(x)$ and $f_2(x)$ are the brightness calibration function associated with a color axis. The color axis is the color distribution defined within a circle based on the hue value, which is an angle in the range of [0, 360° ], e.g., a 3 primary color axis (R, G, B), or 6 color axis (R, G, B, C, M, Y) can be specified. If $f_1(x)$ is associated with a relatively lower hue value, denoted by low, and $f_2(x)$ is associated with a relatively higher hue value, denoted by high, and hue is the hue value for that pixel, then the brightness value for that pixel can be calculated similarly to the following:

$$f_2(x)+(\text{high}-\text{hue})\times(f_1(x)-f_2(x))/(\text{high}-\text{low}),\quad \text{if } f_1(x)>f_2(x),$$

$$\text{or } f_2(x)-(\text{high}-\text{hue})\times(f_2(x)-f_1(x))/(\text{high}-\text{low}),\quad \text{if } f_1(x)<f_2(x).$$

In some implementations, the brightness control may be disabled when saturation is very low. Side effects can be significant after brightness control in the region where low saturation is observed. For example, in a display image where only red and blue colors are set to be brightened, pixels in the white color region may have a hue value close to that of a blue color region, thus the white color region may be brightened as well with the blue color region, which can lead to undesirable side effects. Similar side effects can occur when the saturation value of a region is low. For example, in a region with low saturation, the hue values can be dispersive, and thus may not be visibly different to human eyes. However, the pixels in the region may undergo different brightness calibration. For example, some pixels may get brightened or dimmed heavily, while some pixels may keep the same brightness as the original when their adjacent color axes have gain values equal to 0.

In order to avoid the side effects, two threshold values for saturations can be used. For example, at 305, for each pixel or region on the image, the processing of 306 to 312 (depending on selected) branches may be performed. For example, at 305 a loop may traverse each pixel or region of the image and determine the appropriate processing. For each pixel or region, chroma=(uxu+vxv)>>4, wherein chroma represents the saturation or vividness of the color for the pixel or for the region; u and v represent the coordinate values of the respective color on the color axis; and ">>4" represents right-shifting a value by 4 bits, which is equivalent to dividing the value by $2^4$. For example, u and v may be obtained by subtracting 512 from the two parameters Cb and Cr of the respective color for the pixel, respectively. For the respective pixel or region from 305, the saturation value chroma may then be evaluated to determine whether and how the brightness control is to be implemented, at 306. For example, for each respective pixel or region as shown in 305, if the saturation value chroma<sat_low, a pre-determined lower threshold, brightness calibration may be disabled at 307, the brightness value remains the same as the original value of the pixel or region from 305 and the original value of the pixel or region from 305 is displayed at 308. If chroma≥sat_high, brightness calibration can be enabled at 311, e.g., by applying the brightness control function designed at 303 to the respective pixel or region from 305. The brightness value may be set to be x+d(x) as described above. For the pixel with chroma ϵ [sat_low, sat_high], the brightness value can be recalculated, e.g., set as Y=x+d(x)×(chroma−sat_low)/(sat_high−sat_low) at 309. Thus the pixel or region corresponding with the location of the pixel or region 305 with revised brightness values can be displayed at 312. An example of the saturation thresholds can be sat_low=0x500, sat_high=0xF00.

Table 1 provides example specification of hardware registers related to brightness control. In some implementations, 4 registers can be used for each color axis, including min, max, turn point and gain. For example, there are 14 color axes. In order to keep independent control for each color axis, 14×4 registers are listed below for all color axes in total.

TABLE 1

Register Specification

| Register Mnemonic | Type | Addr | Width | Default | Description |
|---|---|---|---|---|---|
| CMU_BC_M_GAIN1 | R/W | | 10 | 0x000 | Gain for each color axis, represents the brightness difference of (output − input) for the turning point, which must be located at the middle of Min and Max. Default value of 0 means there is no brightness change. Gain can be positive and negative. In addition, Gain ≤ (Max − Min)/4 must be satisfied. |
| CMU_BC_M_GAIN2 | R/W | | 10 | 0x000 | |
| CMU_BC_M_GAIN3 | R/W | | 10 | 0x000 | |
| CMU_BC_M_GAIN4 | R/W | | 10 | 0x000 | |
| CMU_BC_M_GAIN5 | R/W | | 10 | 0x000 | |
| CMU_BC_M_GAIN6 | R/W | | 10 | 0x000 | |
| CMU_BC_M_GAIN7 | R/W | | 10 | 0x000 | |
| CMU_BC_M_GAIN8 | R/W | | 10 | 0x000 | |
| CMU_BC_M_GAIN9 | R/W | | 10 | 0x000 | |
| CMU_BC_M_GAIN10 | R/W | | 10 | 0x000 | |
| CMU_BC_M_GAIN11 | R/W | | 10 | 0x000 | |
| CMU_BC_M_GAIN12 | R/W | | 10 | 0x000 | |
| CMU_BC_M_GAIN13 | R/W | | 10 | 0x000 | |
| CMU_BC_M_GAIN14 | R/W | | 10 | 0x000 | |
| CMU_BC_M_MIN1 | R/W | | 10 | 0x000 | The brightness calibration is only applied in the input window [Min, Max]. Min is the lower limit of the window. |
| CMU_BC_M_MIN2 | R/W | | 10 | 0x000 | |
| CMU_BC_M_MIN3 | R/W | | 10 | 0x000 | |
| CMU_BC_M_MIN4 | R/W | | 10 | 0x000 | |
| CMU_BC_M_MIN5 | R/W | | 10 | 0x000 | |
| CMU_BC_M_MIN6 | R/W | | 10 | 0x000 | |
| CMU_BC_M_MIN7 | R/W | | 10 | 0x000 | |
| CMU_BC_M_MIN8 | R/W | | 10 | 0x000 | |
| CMU_BC_M_MIN9 | R/W | | 10 | 0x000 | |
| CMU_BC_M_MIN10 | R/W | | 10 | 0x000 | |
| CMU_BC_M_MIN11 | R/W | | 10 | 0x000 | |
| CMU_BC_M_MIN12 | R/W | | 10 | 0x000 | |
| CMU_BC_M_MIN13 | R/W | | 10 | 0x000 | |
| CMU_BC_M_MIN14 | R/W | | 10 | 0x000 | |
| CMU_BC_M_MAX1 | R/W | | 10 | 0x3FF | The brightness calibration is only applied in the input window [Min, Max]. Max is the upper limit of the window. |
| CMU_BC_M_MAX2 | R/W | | 10 | 0x3FF | |
| CMU_BC_M_MAX3 | R/W | | 10 | 0x3FF | |
| CMU_BC_M_MAX4 | R/W | | 10 | 0x3FF | |
| CMU_BC_M_MAX5 | R/W | | 10 | 0x3FF | |
| CMU_BC_M_MAX6 | R/W | | 10 | 0x3FF | |
| CMU_BC_M_MAX7 | R/W | | 10 | 0x3FF | |
| CMU_BC_M_MAX8 | R/W | | 10 | 0x3FF | |
| CMU_BC_M_MAX9 | R/W | | 10 | 0x3FF | |
| CMU_BC_M_MAX10 | R/W | | 10 | 0x3FF | |
| CMU_BC_M_MAX11 | R/W | | 10 | 0x3FF | |
| CMU_BC_M_MAX12 | R/W | | 10 | 0x3FF | |
| CMU_BC_M_MAX13 | R/W | | 10 | 0x3FF | |
| CMU_BC_M_MAX14 | R/W | | 10 | 0x3FF | |
| CMU_BC_M_CHROMA_LOW | R/W | | 16 | 0x0500 | Global register for all color axes. If chroma is less |

TABLE 1-continued

| Register Specification | | | | | |
|---|---|---|---|---|---|
| Register Mnemonic | Type | Addr | Width | Default | Description |
| | | | | | than this threshold, no brightness change is applied. |
| CMU_BC_M_CHROMA_HIGH | R/W | | 16 | 0X0F00 | Global register for all color axes. If chroma is larger than this threshold, complete brightness change is applied. |

Figure 6:
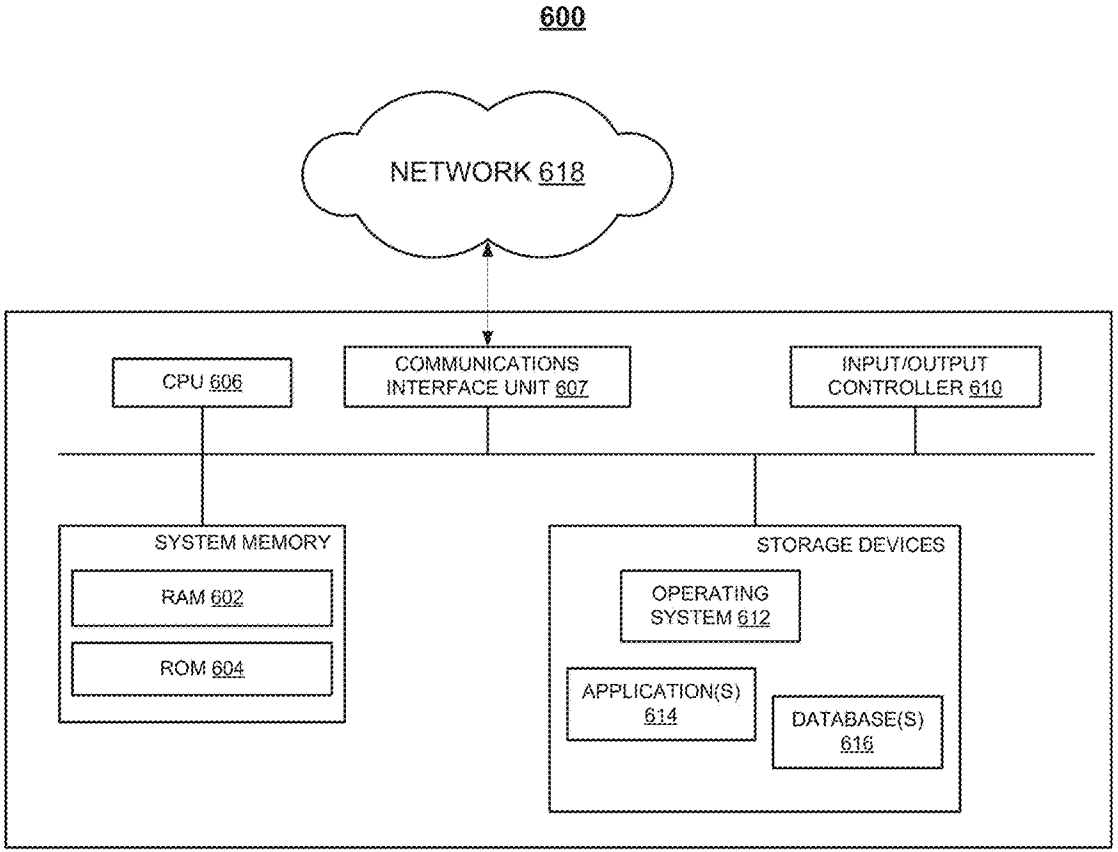
FIG. 6 is a block diagram of a computing device, such as any of the components of the systems of FIGS. 1-5, for performing any of the processes described herein, according to an illustrative embodiment.

FIG. 6 is a block diagram of a computing device, such as any of the components of the systems of FIGS. 1-5, for performing any of the processes described herein. Each of the components of these systems may be implemented on one or more computing devices 600. In certain aspects, a plurality of the components of these systems may be included within one computing device 600. In certain implementations, a component and a storage device may be implemented across several computing devices 600.

The computing device 600 includes at least one communications interface unit, an input/output controller 610, system memory, and one or more data storage devices. The system memory includes at least one random access memory (RAM 602) and at least one read-only memory (ROM 604). All of these elements are in communication with a central processing unit (CPU 606) to facilitate the operation of the computing device 600. The computing device 600 may be configured in many different ways. For example, the computing device 600 may be a conventional stand-alone computer or alternatively, the functions of computing device 600 may be distributed across multiple computer systems and architectures. Alternatively, a computer system may be virtualized to provide the functions of multiple computing devices 600. In FIG. 6, the computing device 600 is linked, via network or local network, to other servers or systems.

The computing device 600 may be configured in a distributed architecture, wherein databases and processors are housed in separate units or locations. Some units perform primary processing functions and contain at a minimum a general controller or a processor and a system memory. In distributed architecture implementations, each of these units may be attached via the communications interface unit 608 to a communications hub or port (not shown) that serves as a primary communication link with other servers, client or user computers and other related devices. The communications hub or port may have minimal processing capability itself, serving primarily as a communications router. A variety of communications protocols may be part of the system, including, but not limited to: Ethernet, SAP, SAS™, ATP, BLUETOOTH™, GSM and TCP/IP.

The CPU 606 includes a processor, such as one or more conventional microprocessors and one or more supplementary co-processors such as math co-processors for offloading workload from the CPU 606. The CPU 606 is in communication with the communications interface unit 608 and the input/output controller 610, through which the CPU 606 communicates with other devices such as other servers, user terminals, or devices. The communications interface unit 608 and the input/output controller 610 may include multiple communication channels for simultaneous communication with, for example, other processors, servers or client terminals.

The CPU 606 is also in communication with the data storage device. The data storage device may include an appropriate combination of magnetic, optical or semiconductor memory, and may include, for example, RAM 602, ROM 604, flash drive, an optical disc such as a compact disc or a hard disk or drive. The CPU 606 and the data storage device each may be, for example, located entirely within a single computer or other computing device; or connected to each other by a communication medium, such as a USB port, serial port cable, a coaxial cable, an Ethernet cable, a telephone line, a radio frequency transceiver or other similar wireless or wired medium or combination of the foregoing. For example, the CPU 606 may be connected to the data storage device via the communications interface unit 607. The communications interface unit 607 may include a network interface that is connected to the network 618. The communications interface unit 607 may also include an input/output interface that obtains an input image for display on an output interface. The CPU 606 may be configured to perform one or more particular processing functions, such as the brightness control mechanism as discussed in FIG. 3.

The data storage device may store, for example, (i) an operating system 612 for the computing device 600; (ii) one or more applications 614 (e.g., computer program code or a computer program product) adapted to direct the CPU 606 in accordance with the systems and methods described here, and particularly in accordance with the processes described in detail with regard to the CPU 606; or (iii) database(s) 616 adapted to store information that may be utilized to store information required by the program.

The operating system 612 and applications 614 may be stored, for example, in a compressed, an uncompiled and an encrypted format, and may include computer program code. The instructions of the program may be read into a main memory of the processor from a computer-readable medium other than the data storage device, such as from the ROM 604 or from the RAM 602. While execution of sequences of instructions in the program causes the CPU 606 to perform the process steps described herein, hard-wired circuitry may be used in place of, or in combination with, software instructions for implementation of the processes of the present invention. Thus, the systems and methods described are not limited to any specific combination of hardware and software.

Suitable computer program code may be provided for performing one or more functions in relation to performing the processes as described herein. The program also may include program elements such as an operating system 612, a database management system and "device drivers" that allow the processor to interface with computer peripheral devices (e.g., a video display, a keyboard, a computer mouse, etc.) via the input/output controller 610. For example, the brightness control mechanism may be implemented by the system 600. The CPU 606 may design the brightness control mapping function and apply the brightness control mapping function to adjust the brightness parameter as discussed in connection with FIG. 3. The adjusted brightness parameter may be sent to a peripheral video display that is connected via the output controller 610, or sent to a remote display system via the communication interface unit 607. The designed brightness control mapping function and various associated parameters such as the saturation value or hue value associated with a pixel within an input image may be stored at the system RAM 602 or ROM 604. In a further implementation, the system memory may store processor-readable instructions to perform brightness control, such as the mechanism discussed in connection with FIGS. 1-5.

The term "computer-readable medium" as used herein refers to any non-transitory medium that provides or participates in providing instructions to the processor of the computing device 600 (or any other processor of a device described herein) for execution. Such a medium may take many forms, including but not limited to, non-volatile media and volatile media. Nonvolatile media include, for example, optical, magnetic, or opto-magnetic disks, or integrated circuit memory, such as flash memory. Volatile media include dynamic random access memory (DRAM), which typically constitutes the main memory. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM or EEPROM (electronically erasable programmable read-only memory), a FLASH-EEPROM, any other memory chip or cartridge, or any other non-transitory medium from which a computer can read.

Various forms of computer readable media may be involved in carrying one or more sequences of one or more instructions to the CPU 606 (or any other processor of a device described herein) for execution. For example, the instructions may initially be borne on a magnetic disk of a remote computer (not shown). The remote computer can load the instructions into its dynamic memory and send the instructions over an Ethernet connection, cable line, or even telephone line using a modem. A communications device local to a computing device 600 (e.g., a server) can receive the data on the respective communications line and place the data on a system bus for the processor. The system bus carries the data to main memory, from which the processor retrieves and executes the instructions. The instructions received by main memory may optionally be stored in memory either before or after execution by the processor. In addition, instructions may be received via a communication port as electrical, electromagnetic or optical signals, which are exemplary forms of wireless communications or data streams that carry various types of information.

It will be apparent that aspects of the systems and methods described herein may be implemented in many different forms of software, firmware, and hardware in the implementations illustrated in the drawings. The actual software code or specialized control hardware used to implement aspects consistent with the principles of the systems and method described herein is not limiting. Thus, the operation and behavior of the aspects of the systems and methods were described without reference to the specific software code—it being understood that one of ordinary skill in the art would be able to design software and control hardware to implement the aspects based on the description herein.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Various aspects of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. The communication network can include, for example, any one or more of a personal area network (PAN), a local area network (LAN), a campus area network (CAN), a metropolitan area network (MAN), a wide area network (WAN), a broadband network (BBN), the Internet, and the like. Further, the communication networks can include, but are not limited to, for example, any one or more of the following network topologies, including a bus network, a star network, a ring network, a mesh network, a star-bus network, tree or hierarchical network, or the like. The communications modules can be, for example, modems or Ethernet cards.

As discussed above, computing system 600 can include clients and servers. A client and server are generally remote from each other and typically interact through a communication network. The relationship of client and server arises by virtue of computer programs running on the respective computers and having a client-server relationship to each other. Computer system 600 can be, for example, and without limitation, an enterprise server or group of servers, one or more desktop computers, one or more laptop computers, etc. Computer system 600 can also be embedded in another device, for example, and without limitation, a mobile telephone, a personal digital assistant (PDA), a mobile audio player, a Global Positioning System (GPS) receiver, a video game console, and/or a television set top box.

While this specification contains many specifics, these should not be construed as limitations on the scope of what may be claimed, but rather as descriptions of particular implementations of the subject matter. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

While operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the aspects described above should not be understood as requiring such separation in all aspects, and it should be understood that the described program components and systems can generally be integrated together in a single software product or packaged into multiple software products.

The subject matter of this specification has been described in terms of particular aspects, but other aspects can be implemented and are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous. Other variations are within the scope of the following claims.

What is claimed is:

1. A method for providing brightness control of a display, the method comprising:

obtaining an image including a first pixel associated with a first color and a second pixel associated with a second color for display;

generating a first brightness control mapping for the first color and a second brightness control mapping for the second color;

applying linear interpolation between the first brightness control mapping and the second brightness control mapping for a third pixel within the image having a third color different from the first color and the second color;

determining a first saturation value corresponding to the first pixel;

comparing the first saturation value with a first previously defined saturation threshold and a second previously defined saturation threshold;

when the first saturation value is less than the first previously defined saturation threshold, disabling brightness control with the first pixel;

when the first saturation value is greater than the first previously defined saturation threshold but less than the second previously defined saturation threshold, re-calculating a first brightness control parameter for the first pixel based on the first previously defined saturation threshold and the second previously defined saturation threshold;

when the first saturation value is greater than second previously defined saturation threshold, applying the first brightness control mapping to the first pixel;

applying the second brightness control mapping to the second pixel based on a second saturation value of the second pixel;

applying the linear interpolation to the third pixel based on a third saturation value of the third pixel; and displaying an output image including the first pixel, the second pixel and the third pixel after the applying.

2. The method of claim 1, wherein the first color and the second color belong to a color axis.

3. The method of claim 1, wherein designing the first brightness control mapping comprises:

designing a piecewise linear gradient such that a second derivative of the first brightness control mapping is a constant.

4. The method of claim 3, wherein designing the first brightness control mapping further comprises:

deriving the first brightness control mapping based on the designed piecewise linear gradient.

5. The method of claim 1, further comprising:

selecting a set of colors including the first color and the second color, wherein each color from the set of colors is associated with a respective color axis, and wherein each respective color axis is associated with a designed brightness control mapping.

6. The method of claim 5, wherein the first color has a first hue value, the second color has a second hue value and the third color has a third hue value, and wherein the first hue value is lower than the third hue value.

7. The method of claim 6, wherein the second hue value is higher than the third hue value.

8. The method of claim 1, wherein the first previously defined saturation threshold is lower than the second previously defined saturation threshold.

9. A system for brightness control of a display, the system comprising:

an input interface configured to obtain an image including a first pixel associated with a first color and a second pixel associated with a second color for display;

control circuitry communicatively coupled to the input interface, the control circuitry being configured to:

generate a first brightness control mapping for the first color and a second brightness control mapping for the second color, apply linear interpolation between the first brightness control mapping and the second brightness control mapping for a third pixel within the image having a third color different from the first color and the second color, determine a first saturation value corresponding to the first pixel;

compare the first saturation value with a first previously defined saturation threshold and a second previously defined saturation threshold;

when the first saturation value is less than the first previously defined saturation threshold, disable brightness control with the first pixel;

when the first saturation value is greater than the first previously defined saturation threshold but less than the second previously defined saturation threshold, re-calculate a first brightness control parameter for the first pixel based on the first previously defined saturation threshold and the second previously defined saturation threshold;

when the first saturation value is greater than second previously defined saturation threshold, apply the first brightness control mapping to the first pixel based on a first saturation value of the first pixel, apply the second brightness control mapping to the second pixel based on a second saturation value of the second pixel, and apply the linear interpolation to the third pixel based on a third saturation value of the third pixel; and an output interface to display an output image including the first pixel, the second pixel and the third pixel after the applying.

10. The system of claim 9, wherein the first color and the second color belong to a color axis.

11. The system of claim 9, wherein the control circuitry is further configured to:

design a piecewise linear gradient such that a second derivative of the first brightness control mapping is a constant.

12. The system of claim 11, wherein the control circuitry is further configured to:

derive the first brightness control mapping based on the designed piecewise linear gradient.

13. The system of claim 9, wherein the control circuitry is further configured to:

select a set of colors including the first color and the second color, wherein each color from the set of colors is associated with a respective color axis, and wherein each respective color axis is associated with a designed brightness control mapping.

14. The system of claim 13, wherein the first color has a first hue value, the second color has a second hue value and the third color has a third hue value, and wherein the first hue value is lower than the third hue value.

15. The system of claim 14, wherein the second hue value is higher than the third hue value.

16. The system of claim 9, wherein the first previously defined saturation threshold is lower than the second previously defined saturation threshold.

* * * * *